US005110271A

United States Patent [19]

Hofmann

[11] Patent Number: 5,110,271

[45] Date of Patent: May. 5, 1992

[54] HAND-OPERABLE DOUBLE-ACTION METERING AND/OR ATOMIZING PUMP

[76] Inventor: Jörg Hofmann, Kreuzstrasse 11, Kreuzwertheim, Fed. Rep. of Germany, D-6983

[21] Appl. No.: 620,246

[22] Filed: Nov. 30, 1990

[30] Foreign Application Priority Data

Dec. 4, 1989 [DE] Fed. Rep. of Germany ..... 3940101

[51] Int. Cl.[5] ..... F04B 21/02

[52] U.S. Cl. ..... 417/555.1; 417/552; 222/385; 222/321

[58] Field of Search ..... 417/555.1, 552; 222/383, 385, 321

[56] References Cited

U.S. PATENT DOCUMENTS 4,643,338 2/1987 Iizuka ..... 222/321

FOREIGN PATENT DOCUMENTS 2838613 3/1980 Fed. Rep. of Germany ..... 417/552

*Primary Examiner*—Richard A. Bertsch
*Assistant Examiner*—Charles Freay
*Attorney, Agent, or Firm*—Townsend and Townsend

[57] ABSTRACT

In a hand-operable double-action metering and/or atomizing pump, comprising a pump body having a pump cylinder and a pump plunger mounted therein, the pump cylinder being provided with a downwardly directed tubular extension forming a transition to a suction tube, on the pump plunger an extension is formed in the axial direction of the pump and extends into the tubular extension. Arranged on the tubular extension is an encircling sealing lip which points in the direction towards the pump cylinder and bears sealingly on the pump plunger extension.

9 Claims, 1 Drawing Sheet

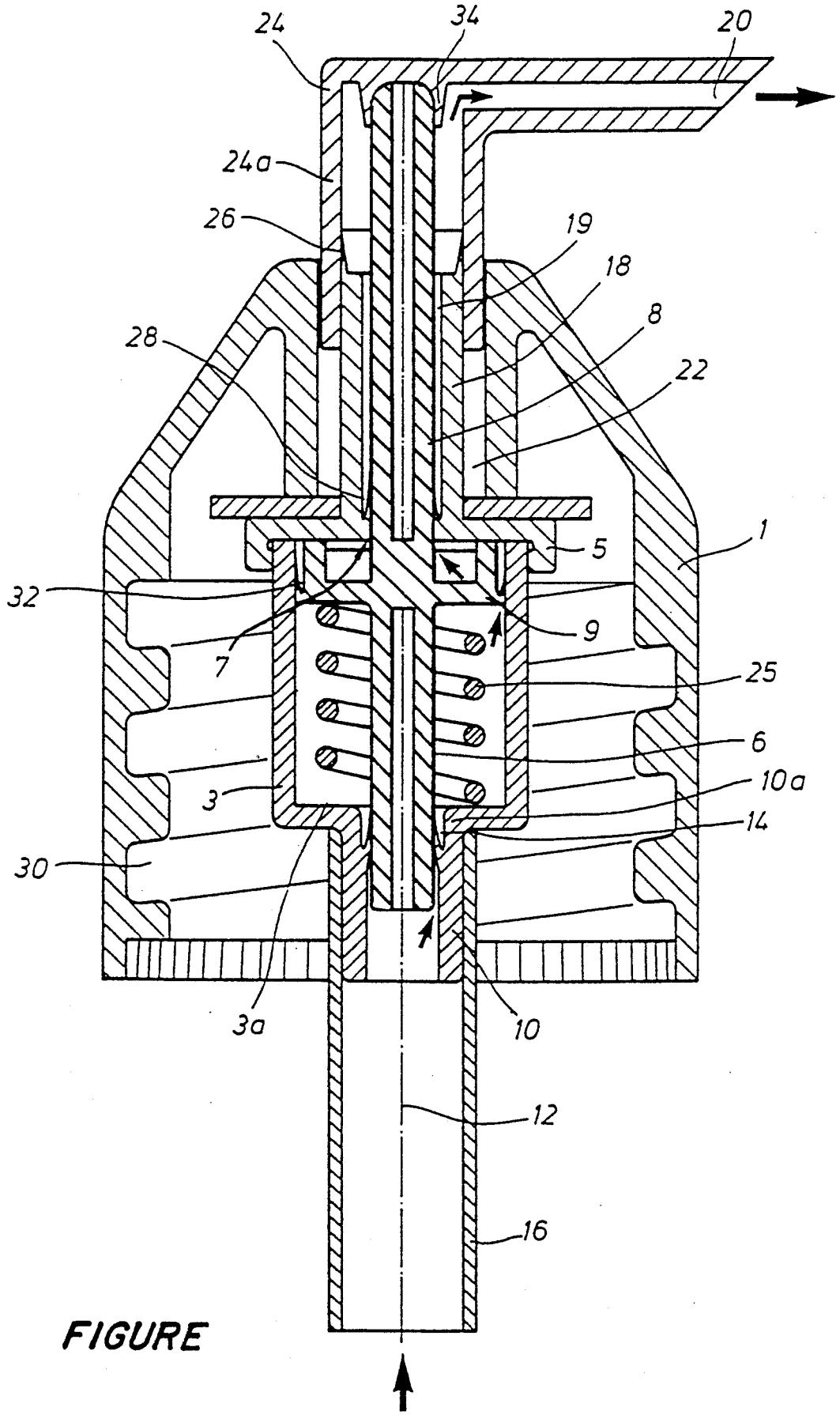
FIGURE

HAND-OPERABLE DOUBLE-ACTION METERING AND/OR ATOMIZING PUMP

The invention relates to a hand-operable double-action metering and/or atomizing pump.

A pump is known from DE-PS 3,246,442 and is equipped in the transition region between the pump cylinder and the suction tube with a valve which prevents passage of the liquid inspired via the suction tube back from the pump cylinder to a container on downward movement of the pump plunger. According to one embodiment the valve is formed by a ball valve and in another embodiment instead of a ball valve a sleeve is provided which comprises a sleeve portion which extends inclined upwardly back in the direction towards the cylinder wall and which effects a seal between the cylinder wall and a cage sealing the bottom of the cylinder. To permit passage of liquid into the pump cylinder the sleeve and the cage are provided with a passage opening.

The use of a sleeve or collar packing in conjunction with the cage involves a relatively high production expenditure combined with the disadvantage that apart from the pump cylinder as valve a unit consisting of several parts is necessary. Due to the tolerances to be observed this results in sealing problems and in addition there are difficulties in the assembly of collar packing or sleeve and cage because the latter must be inserted exactly into the relatively long pump cylinder.

The invention is based on the problem of further developing a pump of the type mentioned at the beginning in such a manner that with simple structure it ensures reliable operation.

Further development of the pump will be apparent from the subsidiary claims.

The invention provides a pump in which to avoid a backflow of the inspired liquid a valve unit is provided which consists of a sealing lip preferably integrally formed on the neck portion of the pump cylinder and directed towards the pump cylinder in such a manner that the sealing lip sealingly bears on an extension of the plunger preferably having a circular cross-section.

According to a preferred embodiment a further sealing unit formed by an upwardly directed sealing lip is provided in the region of the plunger rod and is in sealing contact with the plunger rod and thereby provides an additional sealing between the upper portion of the pump cylinder and the plunger rod.

With the pump according to the invention a simple assembly is achieved in the region of the pump body, the pump plunger and the valves disposed at the lower side and possibly at the upper side of the pump cylinder by using a preferably flat plunger which at its lower side comprises an extension corresponding to the plunger rod. After the introduction of the piston or plunger a sealing is ensured downwardly and if appropriate also upwardly in the region of the plunger rod. As a result, the pump together with the sealing members consists of a relatively small number of individual elements, the sealing lips themselves are already preferably integrally formed on the pump cylinder and it is not necessary to use additional parts to form sealing elements or valves.

Hereinafter a preferred embodiment of the pump will be described with the aid of the drawing to explain further features.

The drawing shows a sectional view through the pump with pump body and pump plunger.

In the embodiment illustrated the pump consists of a pump body 1 which in accordance with the drawing has a substantially upwardly conically tapering shape but may also have any other form. Within the pump body there is a pump cylinder 3 which at its upper side in the drawing is sealed by a flange-like portion 5 and is received by the latter. In the portion 5 there is a central opening 7 for passage of a plunger rod 8. The pump cylinder 3 comprises a portion 10*a* formed at the lower side and reduced in inner and outer diameter compared with the pump cylinder 3, said portion preferably being formed according to the embodiment illustrated by a tubular extension 10 which has a smaller outer diameter than the pump cylinder 3. The inner diameter of the tubular extension 10 is slightly larger than the outer diameter of the piston extension 6 so that the piston extension 6, preferably having a circular cross-section and/or a form corresponding to the plunger rod 8, is movable within the tubular extension 10 in the direction of an axis denoted by 12.

A sealing lip 14 serves as sealing unit between pump cylinder 3 and tubular extension 10 and is formed out of the inner wall of the tubular extension 10 and extends in the direction towards the plunger 9, i.e. is directed upwardly from the tubular extension 10 and is in contact with the outer surface of the piston extension 6. The opening defined in the tubular extension 10 is slightly reduced in cross-section in the region of the foot of the sealing lip 14. The tubular extension 10 is in connection with a suction tube 16 which for example is plugged into or onto the tubular extension 10.

In the embodiment illustrated the tubular extension 10 is surrounded by a suction tube 16, i.e. the suction tube 16 has an inner diameter corresponding to the outer diameter of the tubular extension 10 and can be pushed in simple manner onto the tubular extension 10.

As the drawing shows, the flange-like portion 5 is followed upwardly by a cylindrical portion 18 which serves to receive the plunger rod 8 and with respect to the plunger rod 8 defines an annular chamber 19 through which the liquid or fluid pressed upwardly by the plunger 9 is conducted to an outlet opening 20. If desired, an atomizing nozzle, not illustrated can be inserted into the outlet opening 20.

Between the plunger rod guide 18 and the pump body 1 an annular gap 22 is defined which is larger than the annular gap 19 and serves to permit the displaceability of an actuating head 24 which is used practically as pump member and at the same time for conducting the pumped-up liquid to the outlet opening 20.

In the embodiment illustrated a pressure spring is preferably mounted in the pump cylinder 3 and presses with the one side against the lower surface of the flat piston 9 and thus urges the piston 9 into an upper position. With the other end the spring 25, for example a helical spring, presses onto the bottom 3*a* of the pump cylinder 3. The spring 25 may however also be disposed outside the pump cylinder 3 and for example arranged in a correspondingly designed space 22 and in this case via the actuating head 24 bias the plunger 9 into its upper position.

As shown in the drawing, the plunger rod (8) may be provided at its upper end with a sealing means, preferably an externally disposed sealing lip 26, which bears on the inner wall of the actuating head 24 and prevents passage of liquid disposed in the space between actuating head 24 and plunger rod (8) into the annular space 22.

According to a further embodiment of the pump the plunger rod guide 18 is provided with an encircling upwardly directed sealing lip 28 which bears on the outer wall of the plunger rod 8 and effects a sealing between plunger rod 8 and plunger rod guide 18, i.e. a sealing with respect to the pump cylinder 3. In the embodiment shown the sealing lip 28 is integrally formed on the flange 5 and extends upwardly in the direction towards the plunger rod 8. As is apparent, the sealing lip 28 may also be integrally formed on another point on the inner wall of the plunger rod guide 18.

The pump body 1 is provided in a manner known per se with an inner thread 30 permitting the pump body 1 to be screwed onto a container, which is not shown. Furthermore, the pump body 1 comprises a vent opening which is not illustrated and which permits passage of air from the atmosphere to the container, not shown.

The piston 9 is preferably provided with a lateral upwardly directed sealing lip 32 formed on the plunger 9 encircling the latter or with a corresponding collar packing or sleeve which on its downward movement permits passage of liquid laterally past the plunger 9. On movement of the plunger 9 upwardly the sealing lip 32 presses sealingly against the inner wall of the pump cylinder 3.

When putting the pump shown in the drawing into operation for the first time, on movement of the plunger 9 downwardly by depressing the actuating head 24 the air disposed in the pump cylinder 3 is pressed upwardly past the sealing lip 32. The plunger 9 is pressed downwardly up to the bottom of the pump cylinder designated by 3*a*. Thereafter, by the action of the spring 25 the plunger 9 is raised and via the tubular extension 10 and the suction tube 16 then sucks liquid out of the container into the pump cylinder 3, the liquid being sucked into the pump cylinder 3 between the plunger extension 6 and the sealing lip 14. A subsequent pressing down of the actuating head 24 results in the liquid disposed in the pump cylinder 3 beneath the plunger 9 being subjected to pressure by the blocking action of the sealing lip 14 with respect to the plunger extension 6 and flowing past the lateral sealing lips 32 of the plunger 9, being pressed between the possibly present sealing lip 28 and the plunger rod (8) into the gap denoted by 19 and from there conducted to the outlet opening 20. The pressure generated in the pump cylinder 3 firmly presses the sealing lip 14 onto the wall of the extension 6 and thus prevents a liquid flow from the pump cylinder 3 downwardly into the suction tube 16. Essential to this mode of operation is that the sealing lip 14 integrally formed on the tubular extension 10 on the inner wall thereof bears on the outer wall of the extension 6 in such a manner that it points in the direction towards the pump cylinder 3 (upwardly) and thereby fulfills a blocking function during the downward motion of the plunger 9. During the upward motion of the plunger 9 the sealing lip 14 opens, i.e. it frees a gap with respect to the outer wall of the plunger extension 6 and thereby enables liquid to be sucked in via the suction tube 16.

The sealing lip 32 cooperates with the plunger 9 in similar manner, i.e. when the plunger 9 is raised the sealing lip 32 has a blocking action and on downward movement of the plunger 9 liquid is allowed to pass the sealing lip 32 and the inner wall of the pump cylinder 3 due to the upwardly directed position of said lip. However, the plunger 9 with the sealing lip 32 can also be replaced by a differently formed plunger if the aforementioned mode of operation is possible.

The sealing lip 28 provided according to a preferred embodiment and integrally formed on the flange portion 5 or the cylindrical portion 18 acting possibly as plunger guide or receiving space in such a manner that said lip is also directed upwardly, permits passage of liquid between the seal 28 and the plunger rod 8 on the upward motion of the plunger 9. The sealing lip 28 likewise acts as valve and prevents backflow of liquid disposed in the annular gap 19 during the downward motion of the plunger 9 so that the liquid disposed in the annular gap 19 and in the cavity disposed thereabove is retained during the plunger downward movement.

According to a preferred embodiment of the pump the volume in the pump cylinder 3 is made of the same magnitude or slightly smaller than the volume defined by the annular gap 19 and the cavity located thereabove up to the outlet opening 20. In this manner a continuous delivery of equal amounts of liquid during successive pumping operations is ensured.

In the general operation of the apparatus, liquid is pressed upward and passes lips 32 and lips 28. Movement of liquid past lips 28, and concomitant expulsion of fluid out of opening 20, will occur both when the plunger 9 moves downward as well as when it moves upward. When the pump is operated at least once or twice, gap 19 will be filled with liquid when plunger 9 is maintained in its upward position. Then as plunger 9 is pressed down, liquid contained in the pump cylinder 3 is pressed upwardly, passing lips 32. The liquid contained in gap 19 is then pressed outward, since the volume in the pump cylinder 3 will be the same or slightly smaller than the volume defined by annular gap 19. Furthermore, when plunger 9 has reached its lowest position the lips 28 effectively close, and when plunger 9 moves upwardly again liquid is pressed out of gap 19. In this way, the pump according to the present invention serves as a double-action pump.

The pump according to the invention is preferably made completely or at least largely from plastic, preferably polypropylene (PP), polyfluoroethylene (PFE) or polyamide (PA), so that either all the parts or at least all the functioning parts, such as pump body, plunger and pump cylinder consist of plastic or synthetic resin. It is then possible in one injection moulding operation to form each sealing lip 14, 28 as integral part of the pump and subsequent installation of additional individual parts is superfluous. In particular the sealing lips 14 and 28 have a flexibility and stiffness such that on the one hand a slight movement of their free end away from the plunger extension 6 or plunger rod 8 is possible to permit liquid or the like to pass whilst on the other hand they withstand the pressure of the liquid or the like and conversely ensure a sealing state. The two sealing lips 14, 28 thus operate as valves with a condition "open" or "blocked" depending on the direction of movement of the plunger 9.

The actuating head 24 comprises a downwardly directed cylinder which is designated by 24*a* and which extends into the annular gap space 22 and on actuation of the head member 24 is shifted along the annular gap space 22. Preferably, in the embodiment illustrated the stroke of the plunger 9 is limited downwardly by the length of the cylindrical portion 24*a*.

In the embodiment described above the plunger has a flat shape and a diameter which is greater than the outer diameter of the plunger rod 8 and/or the plunger extension 6. As will be apparent, the dimensioning of the outer diameter of the plunger rod 8, the plunger 9 and the plunger extension 6 can be modified.

In the embodiment illustrated the plunger rod 8 is inserted into a recess 34 formed correspondingly in the actuating head 24, this insertion preferably being a clamping one so that after assembly of the pump body the plunger rod 8 projects out of the upper opening of the pump body and in simple manner the actuating head 24 can be fitted onto the plunger rod 8 with insertion of the cylindrical portion 24 thereof into the annular space 22. For holding the actuating head 24 on the plunger rod 8 a clamping action between the plunger rod 8 and the receiving portion 34 of the actuating head 24 is preferred. The pump cylinder 3 in the embodiment illustrated is preferably clampingly received by the flange 5 but may however be connected to the flange member 5 in any other desired manner.

For injection moulding technology reasons it is preferable to form both the plunger rod 8 and the plunger extension 6 with an axial cavity, thereby saving material; however, on the other hand both the plunger rod and the plunger extension 6 may have a solid cross-section.

I claim:

1. Hand-operable reciprocating metering and/or atomizing pump for the withdrawal of a liquid from a container, comprising a pump body having a pump cylinder and a pump plunger mounted therein, the pump cylinder being provided with a tubular extension forming a transition for connection to a suction tube, the pump plunger having an extension which is formed in the axial direction of the pump and extending into the tubular extension, said tubular extension including a first sealing lip which encircles the tubular extension and is directed towards the pump cylinder, the first sealing lip sealingly bearing on the pump plunger extension and defining a one-way valve that permits liquid to flow along the tubular extension only towards the pump cylinder, and the sealing lip being integrally formed with the tubular extension and being disposed along a line which is spaced from a proximate end of the pump cylinder.

2. Hand-operable reciprocating metering and/or atomizing pump for the withdrawal of a liquid from a container, comprising a pump body having a pump cylinder and a pump plunger mounted therein, the pump cylinder being provided with a tubular extension forming a transition for connection to a suction tube, the plunger including an axially extending rod, the pump plunger having an extension which is formed in the axial direction of the pump and extending into the tubular extension, said tubular extension including a first sealing lip which encircles the tubular extension and is directed towards the pump cylinder, the first sealing lip sealingly bearing on the pump plunger extension and defining a one-way valve that permits liquid to flow along the tubular extension only towards the pump cylinder, the first sealing lip being disposed along a line which is spaced from the proximate end of the pump cylinder, and a member for receiving the plunger rod provided with a second sealing lip which sealingly bears on the plunger rod and encircles said member, the second sealing lip defining a one-way valve permitting liquid to flow along the member only away from the pump cylinder.

3. Hand-operable reciprocating metering and/or atomizing pump comprising a pump body having a pump cylinder and a pump plunger mounted therein, the pump cylinder being provided with a tubular extension forming a transition for connection to a suction tube, the plunger including an axially extending rod, the pump plunger having an extension which is formed in the axial direction of the pump and extending into the tubular extension, said tubular extension including a first sealing lip which encircles the tubular extension and is directed towards the pump cylinder, the first sealing lip sealingly bearing on the pump plunger extension and defining a one-way valve that permits liquid to flow along the tubular extension only towards the pump cylinder, the first sealing lip being disposed along a line which is spaced from the proximate end of the pump cylinder;

a member for receiving the plunger rod provided with a second sealing lip which sealingly bears on the plunger rod and encircles said member, the second sealing lip defining a one-way valve permitting liquid to flow along the member only away from the pump cylinder; and the pump plunger comprising a means for providing a sealing contact between the plunger and the pump cylinder, said sealing means slidingly contacting said pump cylinder.

4. Hand-operable reciprocating metering and/or atomizing pump according to claim 3, wherein said sealing means is comprised of a lateral sealing lip extending towards the plunger rod.

5. Hand-operable reciprocating metering and/or atomizing pump for the withdrawal of a liquid from a container, comprising a pump body having a pump cylinder and a pump plunger mounted therein, the pump cylinder being provided with a tubular extension forming a transition for connection to a suction tube, the plunger including an axially extending rod, the pump plunger having an extension which is formed in the axial direction of the pump and extending into the tubular extension, said tubular extension including a first sealing lip which encircles the tubular extension and is directed towards the pump cylinder, the first sealing lip sealingly bearing on the pump plunger extension and defining a one-way valve that permits liquid to flow along the tubular extension only towards the pump cylinder, the first sealing lip being integrally formed with the tubular extension and being disposed along a line which is spaced from the proximate end of the pump cylinder;

a member for receiving the plunger rod provided with a second sealing lip which sealingly bears on the plunger rod and encircles said member, the second sealing lip defining a one-way valve permitting liquid to flow along the member only away from the pump cylinder;

the pump plunger comprising a means for providing a sealing contact between the plunger and the pump cylinder, said sealing means slidingly contacting said pump cylinder, wherein said sealing means is comprised of a lateral sealing lip extending towards the plunger rod; and said pump body comprising a flange portion for mounting said pump cylinder.

6. Hand-operable reciprocating metering and/or atomizing pump according to claim 2, wherein the second sealing lip extends in a direction away from the pump cylinder.

7. Hand-operable reciprocating metering and/or atomizing pump according to claim 2, wherein the tubular extension comprises an outer diameter being smaller than the outer diameter of the pump cylinder.

8. Hand-operable reciprocating metering and/or atomizing pump according to claim 2, wherein the tubular extension comprises an inner diameter being slightly larger than the outer diameter of the plunger extension.

9. Hand-operable reciprocating metering and/or atomizing pump for the withdrawal of liquid from a container comprising a pump body having a pump cylinder and a pump plunger mounted therein, the pump cylinder being provided with a tubular extension forming a transition for connection to a suction tube of the container, the plunger including an axially extending rod, the pump plunger having an extension which is formed in the axial direction of the pump and extends into the tubular extension, said tubular extension including an annular sealing lip facing the pump cylinder, sealingly engaging the pump plunger extension and defining a one-way valve permitting liquid to flow along the tubular extension towards the pump cylinder only, the sealing lip being integrally formed with the tubular extension and being disposed along a line which is spaced from the proximate end of the pump cylinder, and a member for receiving the plunger rod provided with an annular sealing lip sealingly engaging the plunger rod and defining a one-way valve permitting liquid to flow along the member away from the pump cylinder only.

* * * * *